United States Patent [19]

Chiche

[11] 3,966,887

[45]*June 29, 1976

[54] PROCESS FOR PRODUCTION OF CARBON FIBERS AND THE RESULTANT FIBERS

[75] Inventor: Pierre Chiche, Verneuil-en-Halatte, France

[73] Assignee: Charbonnages de France, Paris, France

[ * ] Notice: The portion of the term of this patent subsequent to Jan. 8, 1991, has been disclaimed.

[22] Filed: Oct. 26, 1972

[21] Appl. No.: 301,150

[30] Foreign Application Priority Data

Nov. 8, 1971 France ..... 71.39939

[52] U.S. Cl. ..... 423/447; 264/29

[51] Int. Cl.[2] ..... D01F 9/12

[58] Field of Search ..... 423/447; 264/29

[56] References Cited

UNITED STATES PATENTS

| | | | |
|---|---|---|---|
| 3,595,946 | 7/1971 | Joo et al. | 423/447 X |
| 3,629,379 | 12/1971 | Otani | 423/447 X |
| 3,639,953 | 2/1972 | Kimura et al. | 423/447 |
| 3,723,609 | 3/1973 | Mansmann et al. | 423/447 |
| 3,769,144 | 10/1973 | Economy et al. | 423/447 |
| 3,784,679 | 1/1974 | Chiche | 423/447 |
| 3,852,428 | 12/1974 | Powell et al. | 423/447 |
| 3,903,220 | 9/1975 | Economy | 423/447 |

OTHER PUBLICATIONS

Otani et al., "Carbon," vol. 4, No. 3, 1966, pp. 425–432.

Yamada et al., "Carbon," vol. 6, No. 5, 1968, pp. 741–742.

*Primary Examiner*—Oscar R. Vertiz
*Assistant Examiner*—Eugene T. Wheelock
*Attorney, Agent, or Firm*—Karl W. Flocks

[57] ABSTRACT

A process for the production of carbon fibers from coal-tar pitch or from other strongly aromatic distillation residues wherein an oxygen-containing polymer is added to the starting material before or during the heat treatment which is followed by the usual stages of spinning, oxidizing and carbonizing.

4 Claims, No Drawings

PROCESS FOR PRODUCTION OF CARBON FIBERS AND THE RESULTANT FIBERS

BACKGROUND OF THE INVENTION

1. Field of the Invention

The present invention relates to the production of carbon fibres from coal tar pitch or other strongly aromatic distillation residues.

2. Description of the Prior Art

Carbon fibres having excellent mechanical properties have already been obtained by oxidation and thermal conversion of fibres of organic polymers, such as polyacrylo-nitrile and rayon. Nevertheless, the cost of fibres obtained in this manner is high because of the cost of the raw materials and the low yield of carbon. Fibres have also been obtained from coal tar pitch by subjecting the pitch to heat treatment at moderate temperature and possibly to other treatments or conditioning, and thereafter melt spinning the pitch so treated at a temperature of the order of 300°C. The fibers so obtained were subjected to oxidation intended to make them infusible, and were then carbonised in air. However, these processes result in fibres of a quality much inferior to that of fibres obtained from textile threads.

It is a main object of the present invention to provide a process producing fibres of improved quality obtained from a coal tar pitch or from a strongly aromatic substance similar to coal tar pitch.

SUMMARY

Carbon fibres are produced from a strongly aromatic distillation residue, such as a coal tar pitch, by firstly subjecting this distillation residue to heat treatment at moderate temperature. Thereafter the product of the heat treatment is spun into fibres which are then oxidised and carbonised. The improvement lies in adding an oxygen-containing polymer, preferably a non-cross linked polymer to the starting distillation residue.

The oxygen-containing polymer may be added to the distillation residue at the latest during the heat treatment phase preceding spinning. Among polymers which have given good results are phenol formaldehyde polymers, particularly first condensation resins such as the novolaks and the polyesters.

The strongly aromatic pitch, after being simply filtered, may be heated under conditions of temperature, time and with agitation such that the material obtained contains very little or no anisotropic material. The presence of this anisotropic material can easily be detected by examination with an optical microscope in polarised light (M. IHNATOWICZ, P. CHICHE, J. DEDUIT, S. PREGERMAIN, and R. TOURNANT, "Carbon" 4, 41, (1966)). This heat treatment may be carried out in a reactor provided with an agitation system and means for scavenging gases. In other words, the heat treatment is stopped, at the latest, at the beginning of the onset of the anisotropic phase.

The process according to the present invention yields fibres having properties of the same order as those obtained by the process of U.S. Pat. application Ser. No. 137,976 filed Apr. 27, 1971, now U.S. Pat. 3,784,679, but because in the process according to the present invention spinning may be carried out at a substantially higher temperature, subsequent operations are greatly facilitated.

DESCRIPTION OF THE PREFERRED EMBODIMENTS

EXAMPLE I

A high temperature coal-tar pitch having the following characteristics was used:

| | |
|---|---|
| Kraemer-Sarnow point | 80°C |
| Density | 1.32 g/cm³ |
| Index of volatile materials (according to standard ATIC-02-60 | 64.3% |
| Elementary analysis in percentages by weight: | |
| Carbon | 92.14% |
| Hyrdogen | 4.5 |
| Oxygen | 1.3 |
| Nitrogen | 0.7 |
| Sulfur | 0.4 |

The pitch had previously been filtered at 190°C through a bronze filter with a mean pore opening of 2 $\mu$ in order to separate the solid and pseudo-solid particles which it contains naturally.

10% by weight of novolak resin of the trade mark GEDELITE 3110 of Societe "Huiles, Goudrons et Derives", obtained by reacting phenol with formaldehyde in acid medium was added to this pitch, this resin having a mean molecular weight of from 500 to 700 and drop-point of 78° at 80°C. The mixture was then heated to 407°C with constant agitation and with a heating rate of 2.2°C per minute. The volatile materials generated were entrained by a current of nitrogen with a flow of 1 liter per minute.

The product obtained was spun at 262°C with a drawing speed of 330 meters per minute.

All the fibre obtained was placed in a furnace and subjected to the following heating sequence:

| | |
|---|---|
| from ambient temperature to 250°C in the presence of air at 0.5°C/minute: | 7.5 hours |
| from 250°C to 700°C) in the presence of nitrogen and without | 15 hours |
| from 700°C to 1000°C) oxygen | 2.5 hours |
| Total | 25 hours |

The furnace was then allowed to cool naturally. The mechanical properties of the carbon fibres obtained were measured with the aid of an INSTROM mechanical test machine under the following conditions:

| | |
|---|---|
| Length of test pieces | 50 mm |
| Speed of traction | 0.05 cm/minute |

A mean breaking stress of 64 kg/mm² and a mean Young's modulus of 4000 kg/mm² were measured for a mean diameter of 13.3$\mu$.

These values are mean values obtained from 100 measurements made on different filaments. The total yield of the operations comprising filtration, devolatilisation, spinning, oxidation and carbonisation was 65%.

EXAMPLE II

The operating conditions were identical to those of Example I, but the phenol-formaldehyde resin was replaced by a NORSODYNE 48, a non-cross-linked polyester resin (propylene glycol polymaleate) dissolved in styrene.

The spinning temperature is 275°C.

A mean breaking stress of 40 kg/mm² and a mean Young's modulus of 3000 kg/mm² were measured on the carbon fibres having a mean diameter of 15.25μ.

EXAMPLE III

The conditions of operation were identical with those of Example I, but the phenol-formaldehyde resin was replaced by NORSODYNE 292, a non-cross-linked polyester resin (mixture of propylene glycol polymaleate and diethylene glycol polymaleate), dissolved in styrene.

The spinning temperature was 270°C.

A mean breaking stress of 48 kg/mm² and a mean Young's modulus of 4000 kg/mm² were measured on the carbon fibres having a mean diameter of 17.37μ.

EXAMPLE IV

The conditions of operation were identical to those of Example I, but the phenol-formaldehyde resin was replaced by NORSODYNE 87, a non-cross-linked polyester resin (mixture of diethylene glycol polymaleate and diethylene glycol polyadipate), dissolved in styrene.

The spinning temperature was 270°C.

A mean breaking stress of 36 kg/mm² and a mean Young's modulus of 3800 kg/mm² are measured on the carbon fibres for a mean diameter of 17.16μ.

EXAMPLE V

The conditions of operation are identical with those of Example I, but here the pitch contains no additive.

The spinning temperature is 230°C.

A mean breaking stress of 25 kg/mm² and a mean Young's modulus of 2800 kg/mm² were measured on the carbon fibres having a mean diameter of 20.48μ.

I claim:

1. In a process for the production of carbon fibres from a strongly aromatic distillation residue pitch, comprising subjecting said pitch to a heat treatment at a temperature approximately 407°C, the product of the heat treatment being thereafter melt spun into fibres which are then oxidized and carbonized, the improvement comprising:

adding to said distillation residue pitch, no later than during the heat treatment, and agitating therewith, a polymer selected from the group consisting of a phenolformaldehyde polymer and a non-cross-linked polyester resin, in an amount approximately 10% by weight and sufficient to improve the mean breaking stress and the mean Young's modulus of the carbonized fibres.

2. A process according to claim 1, wherein the phenol-formaldehyde polymer is a novolak.

3. A process according to claim 1, wherein the heat treatment preceding the spinning is stopped before appearance of the anisotropic phase in the pitch.

4. A process according to claim 1, wherein the heat treatment preceding the spinning is stopped at the commencement of the appearance of the anisotropic phase in the pitch.

* * * * *